United States Patent [19]

Hiller et al.

[11] Patent Number: 4,652,469

[45] Date of Patent: Mar. 24, 1987

[54] SMOOTHING OF ARTICLES OF WOOD IN VIBRATORY ABRASIVE FINISHING MACHINES AND ABRASIVE BODIES PARTICULARLY THEREFOR

[75] Inventors: Rolf Hiller, Kippenheim; Heinrich Vollmer, Wuppertal; Klaus Beckschäfer, Kaarst; Reimund Glodde; Günter Krämer, both of Wuppertal, all of Fed. Rep. of Germany

[73] Assignee: Carl Kurt Walther GmbH & Co. KG, Wuppertal, Fed. Rep. of Germany

[21] Appl. No.: 625,947

[22] Filed: Jun. 29, 1984

[30] Foreign Application Priority Data

Jul. 1, 1983 [DE] Fed. Rep. of Germany ..... 3323711
Mar. 23, 1984 [DE] Fed. Rep. of Germany ... 8408957[U]

[51] Int. Cl.[4] ..... B24B 31/14

[52] U.S. Cl. ..... 427/291; 51/7; 51/313; 51/317; 427/289

[58] Field of Search ..... 51/7, 17, 313, 317; 427/291, 289

[56] References Cited

U.S. PATENT DOCUMENTS 2,684,562 7/1954 Balz ..... 51/317
4,499,692 2/1985 Balz ..... 51/313

*Primary Examiner*—Sam Silverberg
*Attorney, Agent, or Firm*—Martin A. Farber

[57] ABSTRACT

The invention concerns the use of working bodies of low density in vibratory abrasive finishing machines for the smoothing of articles of wood, particularly articles of furniture, between the undercoating and varnishing thereof. The working bodies have either the shape of angular resin-free wooden pins of a size of 4×4×30 mm and an average Shore A hardness of about 95° to 100° or a flat base opposite which there is a head surface corresponding to the shape of a spherical segment.

14 Claims, 7 Drawing Figures

FIG. 1
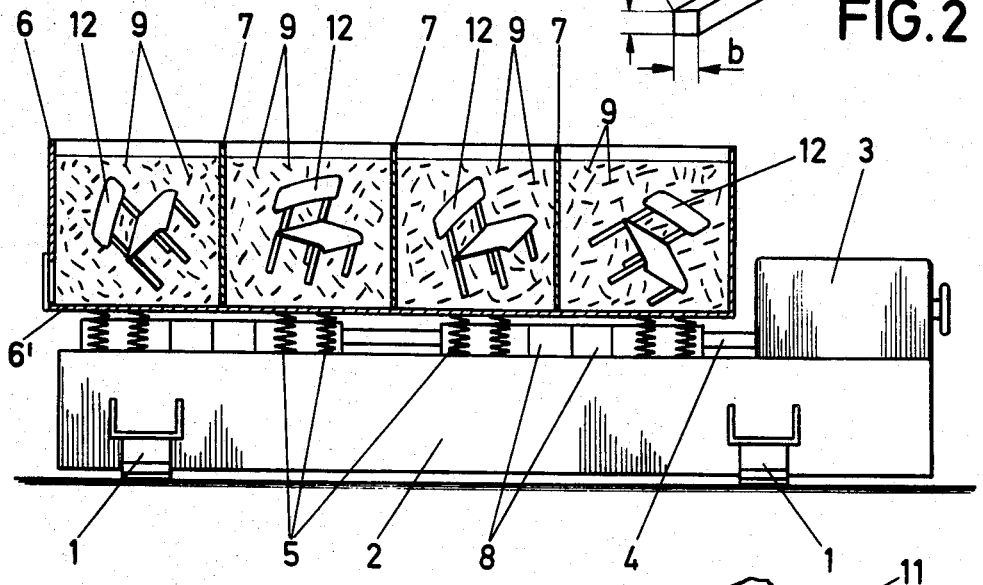
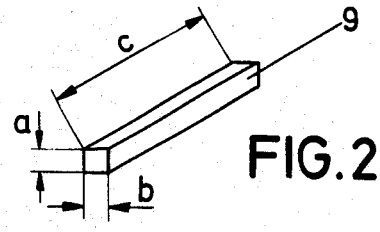
FIG. 2
FIG. 3
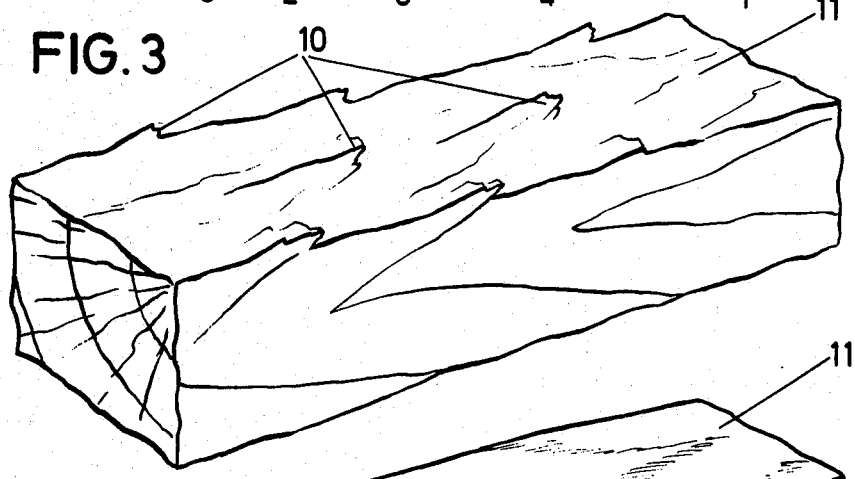
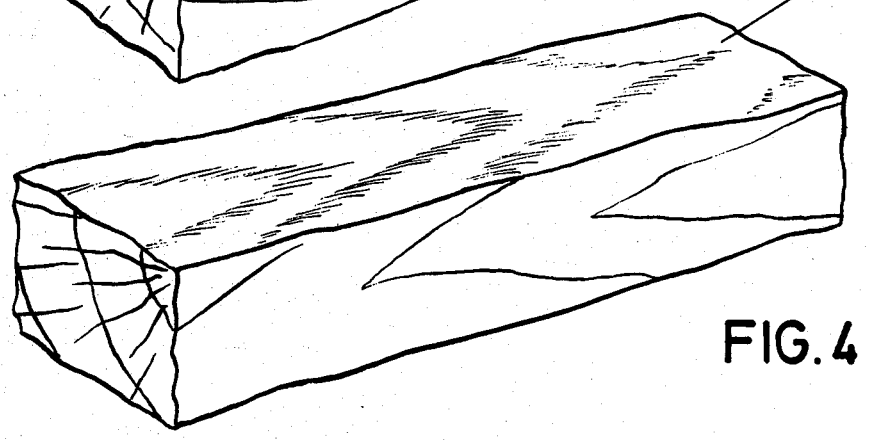
FIG. 4

FIG. 5(a)
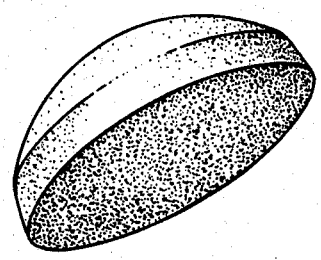
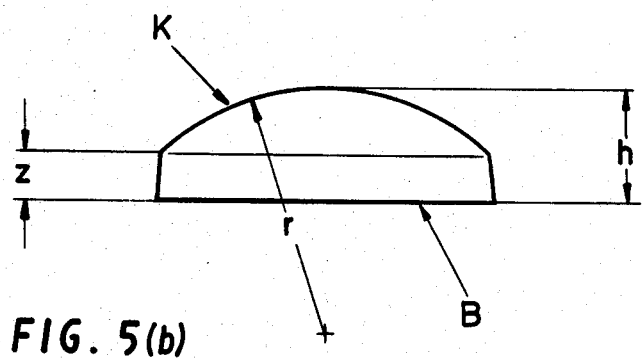
FIG. 5(b)
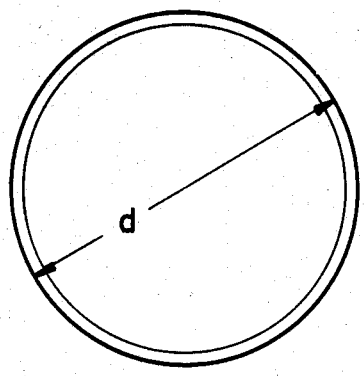
FIG. 5(c)

SMOOTHING OF ARTICLES OF WOOD IN VIBRATORY ABRASIVE FINISHING MACHINES AND ABRASIVE BODIES PARTICULARLY THEREFOR

BACKGROUND AND FIELD OF THE INVENTION

The invention relates to smoothing of articles of wood and abrasive bodies particularly for this purpose.

Wooden surfaces, for instance of furniture, must be ground after they have been primed and before the final varnishing, this being known as the so-called varnish intermediate grinding. This is necessary since the fibers on the surface of the parts are directed perpendicularly upwardly and result in a rough surface. Accordingly the roughness is removed before the final varnishing. Up to now this has been done manually. The shape of the surfaces of, in particular, structured articles of furniture, and the careful handling associated therewith does not permit the use of the customary type of machines. The corresponding abrasion has to be effected also, and in particular, at the corners and edges of the surfaces of the furniture so that the utmost care is necessary when effecting such a varnish intermediate grinding in order not to damage or remove the undercoat.

The object of the invention is to reduce the expense of the varnish intermediate grinding of articles of wood, particularly articles of furniture, regardless of the shape of the surfaces. It is furthermore intended to provide abrasive-finishing bodies in particular for an extremely soft, sensitive grinding.

SUMMARY OF THE INVENTION

This object is achieved by the use of vibratory abrasive finishing machines filled with abrasive bodies of low density for the smoothing by the machine of articles of wood, particularly articles of furniture, between the undercoating and the varnishing stages thereof.

As a result of this teaching, the smoothing of even articles of wood which have already been provided with an undercoat, and in particular articles of furniture, can be carried out economically in suitable vibratory abrasive finishing machines with the addition of certain working bodies. The smoothing of the surface of the articles is now effected by abrasive finishing in which an undefined relative moment which produces an abrasive action takes place between the workpieces (the articles) and the working bodies. Basically a rounding of the edges takes place in this connection. This would mean that the edges of the articles of wood are particularly endangered. However, what is normally desired upon abrasive finishing does not occur with the subject matter of the present application. The undercoat on articles of wood, particularly articles of furniture, is not removed even in the region of their edges. Rather, the smoothing of the articles of wood is limited essentially to the removal of the wooden fibers which have been directed upward by the undercoating and lead to roughness of the surface. The corresponding working can be carried out with pieces of soft wood with which the abrasive finishing vibrator is filled. Experiments have shown that, depending on the size of the articles of furniture, an excellent smoothing of the surface is obtained in this way in a working time of about 5 minutes in suitably large vibratory abrasive finishing machines. The vibratory abrasive finishing machines may be of different shape. They may have working containers forming an annular-trough or a long-trough type. In order to avoid striking of the relatively delicate articles of wood against each other it is advisable to subdivide the working container into individual chambers by partition walls. The working container is subjected to such vibrations that the contents of the container are merely turned about without any advancing movement taking place. For example, the chambers which are partitioned by the partition walls may have such a cross section that they can receive complete wooden chairs. By removing one or more partition walls a larger working space is made available which permits the smoothing of the surface of even larger articles of furniture.

In accordance with the invention it is favorable if the pieces of soft wood used have the shape of angular wooden pins of a size of 4×4×30 mm. The desired varnish intermediate abrasive grinding is characterized in this way by a good and constant quality. All regions of the surface to be worked are definitely acted on. It is advantageous if the degree of hardness of the resin-free pieces of soft wood have an average value of about 95° to 100° Shore A. Birchwood has proven particularly suitable for this in experiments.

Another chip-like body which is of optimum shape from a standpoint of a multiplicity of purposes of use and with which, in particular, its different basic geometrical elements remain substantially unchanged even when a considerable degree of wear is present has a head surface which corresponds to the shape of a spherical segment and is opposite a surface base.

The development of this abrasive finishing body of the invention with reference to a spherical segment has the result that the shape of the abrasive finishing chip in accordance with the invention is a plane, an arch, and an annular edge (line). All of these three geometrical elements are retained, even in the event of extensive wear of the abrasive finishing chip. With an increase in the degree of wear, at most a rounding of the annular edge takes place. The abrasive finishing chips of the invention can be used for finishing processes with high abrading output despite gentle treatment of the workpieces which are made, for instance, of soft wood. The favorable, stable shape of the abrasive finishing chips of the invention guarantees a wide spectrum of use. By adaptation of the vibrations and the initiation of the vibration, a gentle treatment with high abrading output can also be obtained. During the operation the individual chips can assume positions which are particularly favorable for the finishing process; thus, with the interposition of a film of liquid, the base surfaces of two chips can rest against each other providing an abrasive body having the shape of a flat convex lens which, however, is movable along its central plane. For gentle working this development is of great importance. An additional accumulation consisting of a package of more than two chips is, however, prevented. Two chips which are combined to form a unit still afford only places of point contact. Furthermore, a possible adherence-separation effect of the chips is of great importance. Due to the forces of adherence, at times flat workpieces in particular adhere so strongly to each other on their wide surfaces that they form packages. The chips of the invention counteract this by traveling into the opening slots between two workpieces. Inherent in the base surface of the abrasive finishing chips of the invention also is this adhesive adherence to other surfaces. Thus the chips adhere to the wide surfaces of workpieces adhering to each other and then push their narrow edge constantly further between two flat workpieces and thus push them apart.

BRIEF DESCRIPTION OF THE DRAWINGS

The present invention will be described in further detail with reference to the accompanying drawings, in which:

FIG. 1 shows, partly in section, an abrasive finishing vibrator with a long-trough-like working container subdivided into chambers, for the smoothing of furniture parts;

FIG. 2 shows a piece of soft wood in perspective;

FIG. 3 shows, in a greatly enlarged view, a portion of a piece of furniture after the undercoating has been provided, with fibers extending vertically upward from the surface of the wood;

FIG. 4 is a showing corresponding to FIG. 3 after treatment in the abrasive finishing vibrator; and FIGS. 5*a*–5*c* show a working body which is particularly favorable for this purpose and which is also suitable for use as a true abrasive finishing body.

DETAILED DESCRIPTION OF THE PREFERRED EMBODIMENTS

The abrasive finishing vibrator shown is developed as a long-trough vibrator. It has an underframe 2 supported by foot pedestals 1. Above this there extends, on the one side, a housing 3 in which a drive (not shown) is disposed. The underframe 2 supports, via compression springs 5, a long-trough-like vibration abrasion container 6 which is of U-shaped cross section and is subdivided into individual chambers by partition walls 7. In the region between container bottom 6' and inherent in the underframe 2 there are provided vibration generators 8 which are seated on a shaft 4 extending from the drive. The working container 7 is subjected by the vibration generators 8 to vibration such that the content of the container present in the individual chambers undergoes out a circular movement.

The chambers of the working container 6 are filled with pieces of soft wood 9 which represent the abrasive working bodies. In this case no treatment liquid is added, so that entirely dry working takes place. The pieces of soft wood 9 are developed in the shape of angular wooden pins. They have a length c of 30 mm, a width b of 4 mm and a height a of 4 mm. The wooden pins are made of resin-free wood. Birchwood is particularly suitable for this. The average hardness of the pieces 9 of soft wood is about 95° to 100° Shore A.

After undercoating articles of wood, fibers 10 extend from the surfaces 11 of the wood. A fragmentary view on a larger scale is shown in FIG. 3. This fragment is part of a piece of furniture formed as a chair 12 (although the invention is notlimited thereto). The fibers 10 which protrude vertically upwardly, however, necessarily make the surface rough. This roughness of the surface is to be removed before the varnishing. For this purpose an assembled chair 12 is introduced into each chamber which has been filled with the pieces of soft wood 9. It undergoes there an abrasive finishing process, with an undefired relative movement taking place between the chair 12 and the pieces of soft wood 9. By this the protruding wood fibers 10 are removed so that a smooth surface 11', such as shown in FIG. 4, is then present. This finishing process is completed within five minutes in the case of the chairs 12, and always of uniform quality, which cannot be achieved by a manual varnish intermediate abrasive grinding. The smoothing takes place not only on the surfaces but also on the corners and edges, without removing the undercoat in this endangered region.

The process can also be carried out with the use as working bodies of chips shaped in the manner shown in FIGS. 5*a* to 5*c*. The chip has the shape of a spherical segment with a head surface K opposite the base B and a cylindrical-wall side edge z which connects the two surfaces together. The limiting surfaces are a plane, the base surface B, a spherical surface K having the radius r and a rim z between the spherical surface K and the base surface B. The connection between the base surface B and the rim z forms on the circumference of the chip an edge in the form of a line. The diameter d of the spherical segment is a multiple of its height h. The ratio of the diameter d to the height h of the abrasive finishing working bodies is about 3.5. The slight conical inclination of the cylindrical-wall side rim z is provided for reasons of manufacturing technique as it facilitates the removal of the finished chips from the mold after their production.

We claim:

1. A method for smoothening articles of wood, comprising the steps of providing articles of wood having an undercoat, selecting method of low density for the smoothening of the articles of wood, filling a vibratory abrasive finishing machine with the working bodies and the articles of wood, and finishing the articles of wood by the working bodies by vibrating the vibratory abrasive finishing machine before varnishing the articles of wood, without removing the undercoat from edges and corners on the articles of wood.

2. The method of claim 1, wherein said step of selecting the articles of wood having an undercoating comprises the step of undercoating articles of wood initially without an undercoating.

3. The method of claim 1, wherein the working bodies are made of soft-wood.

4. The method of claim 3, wherein the working bodies are angular resin-free wooden pins of a size of substantially 4×4×30 mm and have an average Shore A hardness of about 95° to 100°.

5. The method of claim 1, wherein said abrasive finishing working bodies have a flat base and a head surface having the shape of a spherical segment, said head surface is opposite said base.

6. The method of claim 5, wherein said abrasive finishing working bodies have a diameter of the spherical segment which is a multiple of its height.

7. The method of claim 6, wherein the ratio of the diameter to the height of the abrasive finishing working bodies is about 3.5.

8. The method of claim 7, wherein said abrasive finishing working bodies have a narrow substantially cylindrical side rim between said spherical head surface and said base.

9. The method of claim 1, wherein said working bodies are made of birchwood.

10. The method of claim 1, wherein said articles of wood are articles of furniture.

11. The method of claim 1, wherein said finishing step is a dry working step.

12. The method of claim 1, wherein said vibrating the vibratory abrasive finishing machine causes said articles of wood and said working bodies to undergo a circular movement.

13. The method of claim 1, wherein the vibratory abrasive finishing machine is subdivided into a plurality of individual chambers into which only respectively one of the articles of wood are placed along with said said working bodies.

14. The method of claim 10, wherein said articles of furniture are chairs.

* * * * *